US010487779B2

(12) United States Patent
Beasley

(10) Patent No.: US 10,487,779 B2
(45) Date of Patent: Nov. 26, 2019

(54) PISTON SCRAPING RING WITH POWER GROOVE

(71) Applicant: International Engine Intellectual Property Company, LLC, Lisle, IL (US)

(72) Inventor: John Lloyd Beasley, Chicago, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 5 days.

(21) Appl. No.: 15/463,842

(22) Filed: Mar. 20, 2017

(65) Prior Publication Data

US 2018/0266359 A1 Sep. 20, 2018

(51) Int. Cl.

*F02F 1/00* (2006.01)
*F02F 11/00* (2006.01)
*F02F 1/18* (2006.01)

(52) U.S. Cl.

CPC ..... *F02F 11/002* (2013.01); *F02F 1/00* (2013.01); *F02F 1/18* (2013.01); *F02F 2001/006* (2013.01)

(58) Field of Classification Search

CPC ..... F02F 2001/006; F02F 1/20; F02F 1/14; F02F 2001/249

USPC ..... 123/193.2

See application file for complete search history.

(56) References Cited

U.S. PATENT DOCUMENTS 4,474,147 A * 10/1984 Hoopes ..... F02F 1/00 123/193.1
5,553,585 A * 9/1996 Paro ..... F16J 10/04 123/193.2
6,942,221 B2 9/2005 Keeley
7,347,176 B1 3/2008 Edgardo
7,429,048 B1 * 9/2008 Carson ..... F16J 9/206 277/434
7,438,037 B2 * 10/2008 Oogake ..... F02F 1/004 123/193.2
9,638,131 B2 * 5/2017 Koci ..... F02B 23/0651
2005/0279296 A1 * 12/2005 Coney ..... F02B 77/11 123/41.84
2007/0107689 A1 * 5/2007 Oogake ..... F02F 1/004 123/193.2
2015/0114373 A1 * 4/2015 Beasley ..... F02F 1/00 123/668

* cited by examiner

*Primary Examiner* — Long T Tran
*Assistant Examiner* — James J Kim
(74) *Attorney, Agent, or Firm* — Jack D. Nimz; Jeffrey P. Calfa; Mark C. Bach

(57) ABSTRACT

A device and method for preventing and removing piston deposit build-up on a piston cylinder assembly of an engine, including a diesel engine, is disclosed. A cylinder having an inner sleeve for receiving a piston, has a piston scraping ring positioned on the cylinder sleeve. The piston scraping ring includes an inner surface, and has a curved or hook shaped feature on its inner surface. The curved or hook shaped feature, named the 'power groove' for the purposes of this application, allows for reduced wear between the piston rings and the cylinder sleeve by reducing the pressure on the piston rings by expanding and reversing the flow of combustion gases. Additionally, this reversal of the combustion gases results in a decrease in blow-by gases passing between the piston rings and cylinder sleeve thereby improving sealing between the piston and the cylinder.

11 Claims, 2 Drawing Sheets

PISTON SCRAPING RING WITH POWER GROOVE

TECHNICAL FIELD

The present device relates to a piston scraping ring for use in a cylinder and piston assembly of an internal combustion engine. Particularly, the device relates to a piston scraping ring having a curved or hook shaped feature, called a 'power groove' for the purposes of this application. The power groove reduces the pressure experienced by the piston rings of the piston by expanding and reversing the direction of a combustion pressure wave when the combustion pressure wave has impact with the power groove. The piston scraping ring additionally ensures a close fit between the piston rings and the cylinder sleeve to decrease blow-by of gases or fluids.

BACKGROUND

In an internal combustion engine, such as a diesel engine, carbon and other products from the combustion process can build up on the land of the piston above the upper compression ring. The build-up typically does not form uniformly due to dimensional variations between the piston and the cylinder sleeve, non-uniform heat distribution and secondary motion of the piston. Excessive carbon build up may lead to problems characteristic of current commercial internal combustion engine piston-cylinder assemblies, namely, excessive crevice volume, premature ring fatigue failure, and excessive blow-by of fluids or induced oil combustion. Blow-by or migration of combustion gases or fluid oil past the piston rings is a continuous problem for piston assembly design. Blow-by of combustion gases to the crank case reduces engine compression and robs the engine of its designed power. Therefore, it is necessary and desirable to prevent these potential issues, as well as, remove any carbon and other deposits on a regular basis.

Piston build-up has been dealt with, for example, by increased clearance between the top land of the piston and the cylinder sleeve and reduced oil consumption through refinements in the piston and piston design rings. Additionally, a piston scraping ring helps to scrape the carbon and other deposits that build-up on the top land of the piston. However, the piston scraping ring still has to provide clearance between the ring and the piston to allow for thermal expansion, deformation due to pressure load, the back and forth motion of the piston (piston secondary motion), and the non-uniform heating to the piston.

Thus, there is a need for effective prevention and removal of piston build-up while addressing the potential issues described above. The present device provides a piston scraping ring having a curved or hook shaped feature or groove that may be called the 'power groove' for the purposes of this application. While this application specifically describes a piston scraping ring, any other piston ring may be implemented to add the power groove feature. This feature or groove causes a combustion pressure wave to expand and reverse direction when the combustion pressure wave has impact with the feature. This impacted wave further acts against the following oncoming pressure wave resulting from combustion and so on, thereby reducing the pressure experienced by the piston rings. The reduction in pressure on the piston rings reduces the wear between the piston rings and the cylinder sleeve. Through this pressure reduction, the power groove additionally improves the sealing capability of the piston rings by reducing blow-by, which in turn, improves the engine efficiency. The present device reduces carbon and other build-up, facilitates removal of carbon and other deposits on the top land of the piston, and lowers pressure on the piston rings.

SUMMARY

Embodiments described herein relate to a cylinder piston assembly comprising a cylinder having an inner sleeve for receiving a piston. A ring is positioned on the cylinder sleeve, the ring including an inner and an outer surface. The inner surface has a feature capable of expanding and reversing the direction of a combustion pressure wave to reduce the pressure on the one or more piston rings of the piston and improve the sealing capacity between the one or more piston rings and the cylinder sleeve.

Additionally, the embodiments described herein relate to a pressure control and sealing and device for use in a cylinder piston assembly, the device having a ring with an inner surface facing the piston. Positioned on an interior sleeve of the cylinder, the inner surface of the ring has a feature for expanding and reversing the direction of an oncoming compression pressure wave.

Finally, the embodiments described herein relate to a method of preventing build-up and reducing pressure and wear on a piston assembly. The method comprises the steps of seating a piston with one or more piston rings within a cylinder sleeve of a cylinder, providing a piston scraping ring having a feature disposed on an inner surface thereof, and positioning the piston scraping ring on an inner diameter of the cylinder sleeve opposing the piston. The feature causes an oncoming combustion pressure wave to expand and reverse direction and act against the next oncoming pressure wave from combustion thereby reducing the pressure on the one or more piston rings and improving sealing capability between the one or more piston rings and the cylinder sleeve of the cylinder.

These and other embodiments and their advantages can be more readily understood from a review of the following detailed description and the corresponding appended drawings.

DETAILED DESCRIPTION

Figure 1:
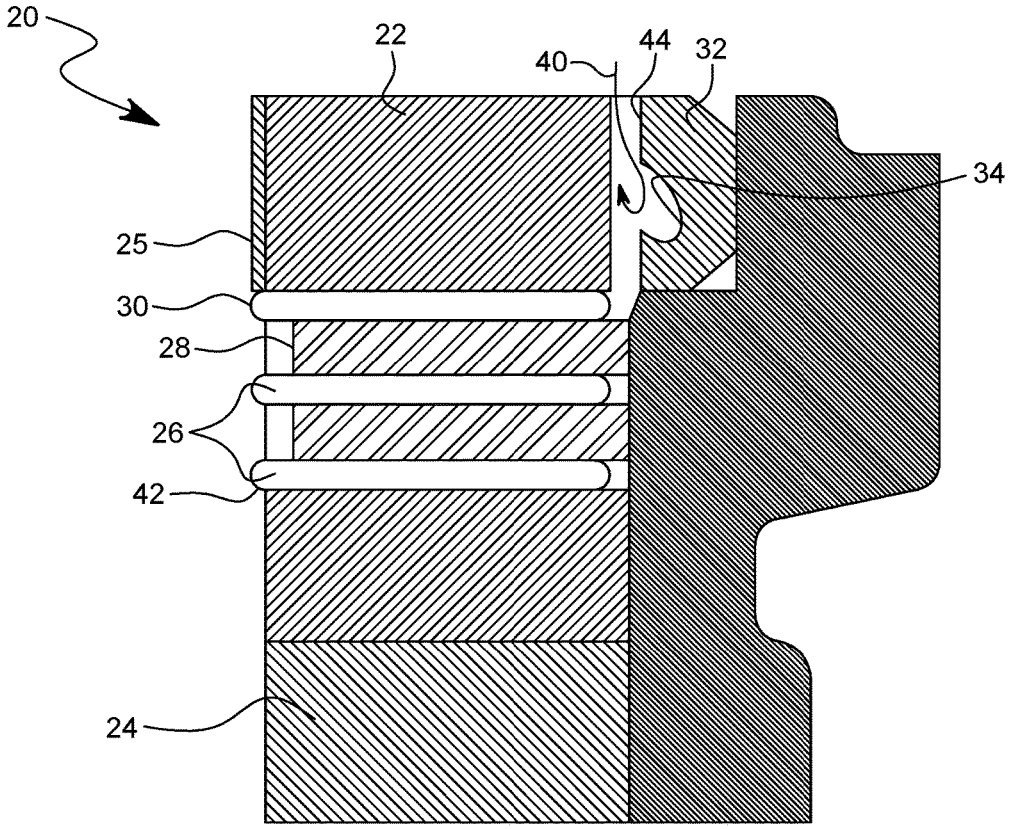
FIG. 1 is sectional view of a cylinder containing a piston and an embodiment of the piston scraping ring of the present disclosure.
Figure 2:
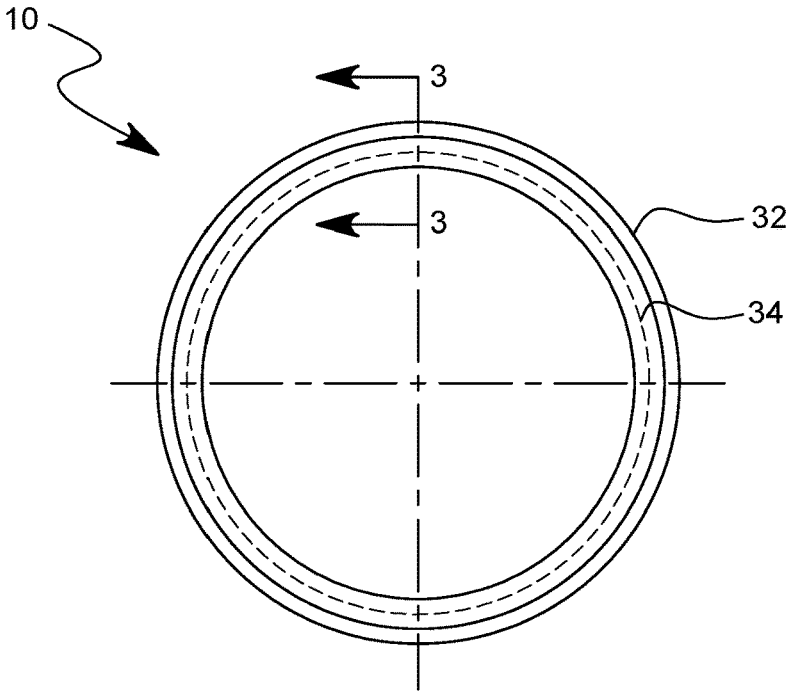
FIG. 2 is a perspective view of the presented piston scraping ring.
Figure 3:
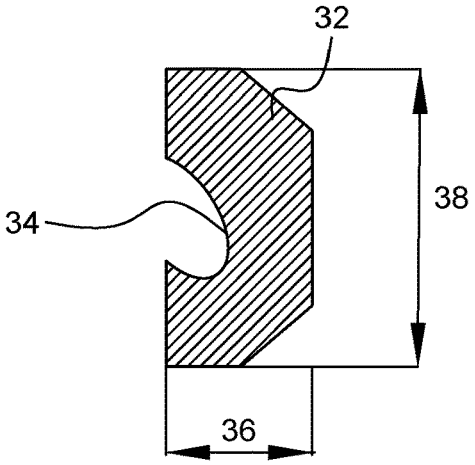
FIG. 3 is a sectional view of the presented piston scraping ring.

Referring to FIGS. 1-3, there is illustrated a piston scraping ring 32 used in an internal combustion engine, including a diesel engine. The piston scraping ring 32 may also be known as an anti-polishing ring. The piston scraping ring 32 in this embodiment is continuous, but may also be discontinuous. An exemplary engine (not shown) includes a block having a plurality of cylinders formed therein. A piston having a plurality of piston rings separated by lands operates within each cylinder. During operation, carbon and other combustion by-product deposits may form on the piston walls above the piston rings, which may result in a variety of potential operating issues. Additionally, the combustion pressure wave applies high pressure on the piston rings which may result in blow-by gases past the piston rings and increase in wear between the piston rings and cylinder sleeve. The present piston scraping ring 32 with the power groove addresses the issues highlighted above while ensuring a close fit between the piston and the cylinder sleeve. While this embodiment uses a piston scraping ring, any other piston ring such as a compression ring or an oil control ring, etc. may be used.

As shown in FIG. 1, a piston cylinder assembly 20 includes a three-ring aluminum alloy or steel piston 22 adapted to operate within an aluminum or cast iron cylinder 24, and specifically within the interior cylinder liner or sleeve 25. The piston body 22 comprises several ring grooves 26 that are annularly defined in the body of the piston, the ring grooves 26 separating the piston body 22 into piston lands 28. A single annular piston compression ring 30 is carried within each of the top two (in case of three groove piston) or top three (in case of four groove piston) ring grooves 26 to dynamically and adjustably maintain contact between the piston body 22 and the cylinder sleeve 25. An oil control ring 42 may be carried in the bottom most ring groove of ring grooves 26. The compression rings 30 and the oil control ring 42 may be collectively referred to as piston rings.

Positioned above the top piston compression ring 30, the cylinder liner or sleeve 25 is provided with a piston scraping ring 32. The piston scraping ring 32 functions to remove carbon deposit, carbon residue and any other combustion by-product deposits that may collect or form at the upper portion or top land of the piston 22 during operation of the engine. The piston scraping ring 32 of the present disclosure includes a power groove 34, which is a curved or hook shaped feature applied to an inner surface 44 of the piston scraping ring 32. While in this embodiment the power groove 34 is applied to the piston scraping ring 32, any other piston ring such as a compression ring 30 or an oil control ring 42, etc. may be used.

The power groove 34, as shown in FIG. 2 and FIG. 3, is machined or added onto an inner surface 44 of the piston scraping ring 32, and in this embodiment, resembles the shape of a hook and is curved against the direction of oncoming combustion waves. The piston scraping ring 32, along with the power groove 34 is designed so as to be in intimate contact with the piston body 22 when the piston is within the cylinder sleeve 25. The power groove 34, is approximately half as deep as the thickness 36 of the piston scraping ring 32 and is applied to approximately the middle portion along the circumference 38 of the piston scraping ring 32. When oncoming combustion gases make contact with the power groove 34, the resulting impact slows down the gases through expansion and then reverses them due to the curved or hook shape of the power groove 34, which, in turn, will expand, slow down and reverse further oncoming combustion waves of gases. Other design features are possible that may result in a similar expansion and reversal of the oncoming combustion gases. While in this embodiment the power groove 34 is applied to the piston scraping ring 32, any other piston ring such as a compression ring 30 or an oil control ring 42, etc. may be used.

Upon operation of the installed piston 22 within the cylinder sleeve 25, the power groove 34 will cause the combustion pressure wave 40 of a combustion event to expand and reverse direction. When the oncoming combustion pressure wave 40 consisting of combustion gases and fluid after a combustion event makes contact with the power groove 34, the resulting impact slows down the pressure wave through expansion and, enabled by the curved shape of the power groove 34, reverses the combustion pressure wave 40. This reversed combustion pressure wave 40 then acts by expanding and reversing any further oncoming pressure waves from combustion thereby reducing the pressure experienced by the one or more annular piston compression rings 30 and the oil control ring 42. The reduction in pressure experienced by the piston rings will result in less blow-by gases past the piston rings and a reduction in the wear between the piston rings and the cylinder sleeve 25. Since there is a reduction in the blow-by gases by reduction of pressure, the power groove 34 improves the sealing capability of the piston rings. Thus, the power groove 34 improves both efficiency and durability of the engine.

A method for preventing piston deposit build-up in a piston cylinder assembly for an engine is described. The method also provides for an increase in the efficiency and durability of an engine by reducing the pressure and increasing sealing capacity between the piston rings and cylinder sleeve.

The present method includes providing a cylinder 24 having a cylinder sleeve 25, and seating a piston 22 within the cylinder sleeve 25. A piston scraping ring 32 having a power groove 34 disposed on the inner surface 44 thereof is positioned on the cylinder sleeve 25 of the cylinder 24, such that the power groove 34 faces the piston 22. While in this embodiment the power groove 34 is applied to the piston scraping ring 32, any other piston ring such as a compression ring 30 or an oil control ring 42, etc. may be used. Through operation of the piston 22 within the cylinder sleeve 25, the power groove 34 will expand any oncoming pressure waves consisting of combustion gases 40 upon impact with the combustion gases 40. Additionally, the hook like, curved shape of the power groove 34 as shown in FIGS. 1 and 3, will reverse the direction of the oncoming pressure wave 40. The reversed oncoming pressure wave 40 then acts by expanding and reversing the next wave of combustion gases generated which will reduce the overall pressure around the piston. This reduction of pressure reduces blow-by gases past the one or more annular compression rings 30 and the oil control ring 42, and also reduces wear between the numerous piston rings and the cylinder sleeve 25. This method results in improved sealing between the piston rings and the cylinder sleeve 25, while preventing carbon and other combustion by-product deposit build-up.

What is claimed is:

1. A cylinder piston assembly for use in an internal combustion engine, the assembly comprising:

a cylinder having an inner sleeve for receiving a piston with one or more piston rings;

a ring positioned and supported on the inner sleeve of the cylinder, the ring including an inner surface and an opposing outer surface;

the piston and cylinder defining combustion wave generating region above the piston in which combustion events occurs generating products of combustion, a lower portion below the piston toward which the piston is exerted by the combustion events, and a gap between the ring and the piston through which the products of combustion may migrate downstream from the combustion wave generating region past the ring; and a teardrop shaped groove formed in the inner surface of the ring; wherein the teardrop shaped groove has a first entry point at a first location, a second entry point at a second location downstream of the first location; and has a portion that extends below the second entry point in the downstream direction.

2. The cylinder piston assembly of claim 1, wherein the products of combustion consist of combustion gases, particles and fluid.

3. The cylinder piston assembly of claim 1, wherein the teardrop shaped groove is approximately midway along a circumference of the ring.

4. The cylinder piston assembly of claim 1, wherein the teardrop shaped groove is curved against the direction of the products of combustion.

5. The cylinder piston assembly of claim 1, wherein the ring is a scraping ring with the inner surface of the scraping ring additionally scraping off deposits on a top land of the piston.

6. The cylinder piston assembly of claim 1, wherein the curve of the teardrop shape against the direction of the products of combustion reduces the pressure on one or more piston rings and improves the sealing capacity between the one or more piston rings and the cylinder sleeve.

7. A pressure control and sealing device for use in a cylinder/piston assembly of an internal combustion engine, the device comprising:

A cylinder having an inner sleeve for receiving a piston with a piston ring;

the piston and cylinder defining a combustion wave generating region above the piston in which the combustion events occur generating products of combustion, a ring positioned on an interior sleeve of a cylinder, the ring including an inner surface facing a piston; and a teardrop shaped groove applied to the inner surface of the ring;

the teardrop shaped groove curved so as to redirect at least a portion of products of combustion towards the combustion wave generating region away from the piston ring.

8. A method for preventing build-up and reducing pressure and wear on a piston assembly, the method comprising the steps of:

providing a piston with one or more piston rings within a cylinder sleeve of a cylinder;

providing a piston scraping ring having a teardrop shaped groove with a first entry point, a second entry point vertically lower than the first entry point, and a recess having a curve point vertically lower than the second entry point on an inner surface of the piston scraping ring within an inner diameter of the cylinder sleeve opposing the piston; and receiving a first oncoming compression pressure wave into the teardrop shaped groove with the recess such that the first oncoming compression pressure wave is deflected back instead of flowing through one or more gaps between the cylinder and the piston assembly.

9. The method of claim 8, wherein the method further improves sealing ability between the one or more piston rings and the cylinder sleeve by reducing the flow of blow-by gases.

10. The method of claim 8, wherein the first oncoming compression pressure wave deflects a second oncoming pressure wave after the first oncoming wave is deflected by the teardrop shaped groove.

11. The cylinder piston assembly of claim 4 wherein the portion of the teardrop shape curve extending between the portion below the second entry point and the second entry point is curved against the direction of the products of combustion.

* * * * *